United States Patent [19]

Carpenter et al.

[11] Patent Number: 4,659,376

[45] Date of Patent: Apr. 21, 1987

[54] FLUID BED REDUCTION TO PRODUCE MOLYBDENUM METAL

[75] Inventors: Kent H. Carpenter; Roger F. Sebenik, both of Ann Arbor, Mich.

[73] Assignee: Amax Inc., Greenwich, Conn.

[21] Appl. No.: 810,891

[22] Filed: Dec. 18, 1985

Related U.S. Application Data

[63] Continuation of Ser. No. 614,213, May 25, 1984, abandoned.

[51] Int. Cl.[4] ..... C22B 1/14

[52] U.S. Cl. ..... 75/84; 266/905

[58] Field of Search ..... 75/26, 3, 84; 266/905

[56] References Cited

U.S. PATENT DOCUMENTS 2,783,187 2/1957 Odell ..... 75/26

3,264,098 8/1966 Heytmeijer ..... 75/26

3,865,573 2/1975 Neumann et al. ..... 75/3

OTHER PUBLICATIONS

Metals Handbook, vol. 2, 8th ed., p. 152, 2/12/74.

*Primary Examiner*—Melvyn J. Andrews

*Assistant Examiner*—S. Kastler

*Attorney, Agent, or Firm*—Michael A. Ciomek; Eugene J. Kalil

[57] ABSTRACT

Molybdenum trioxide in granular or powder form is reduced to molybdenum metal by stagewise fluid bed reduction wherein molybdenum trioxide is reduced to molybdenum dioxide using ammonia as the fluidizing-reducing gas at 400° C. to 650° C. and molybdenum dioxide is reduced to metal using hydrogen as the fluidizing-reducing gas at 700° C. to 1400° C. The content of impurities such as lead, zinc, bismuth and copper is reduced during the process.

4 Claims, 1 Drawing Figure

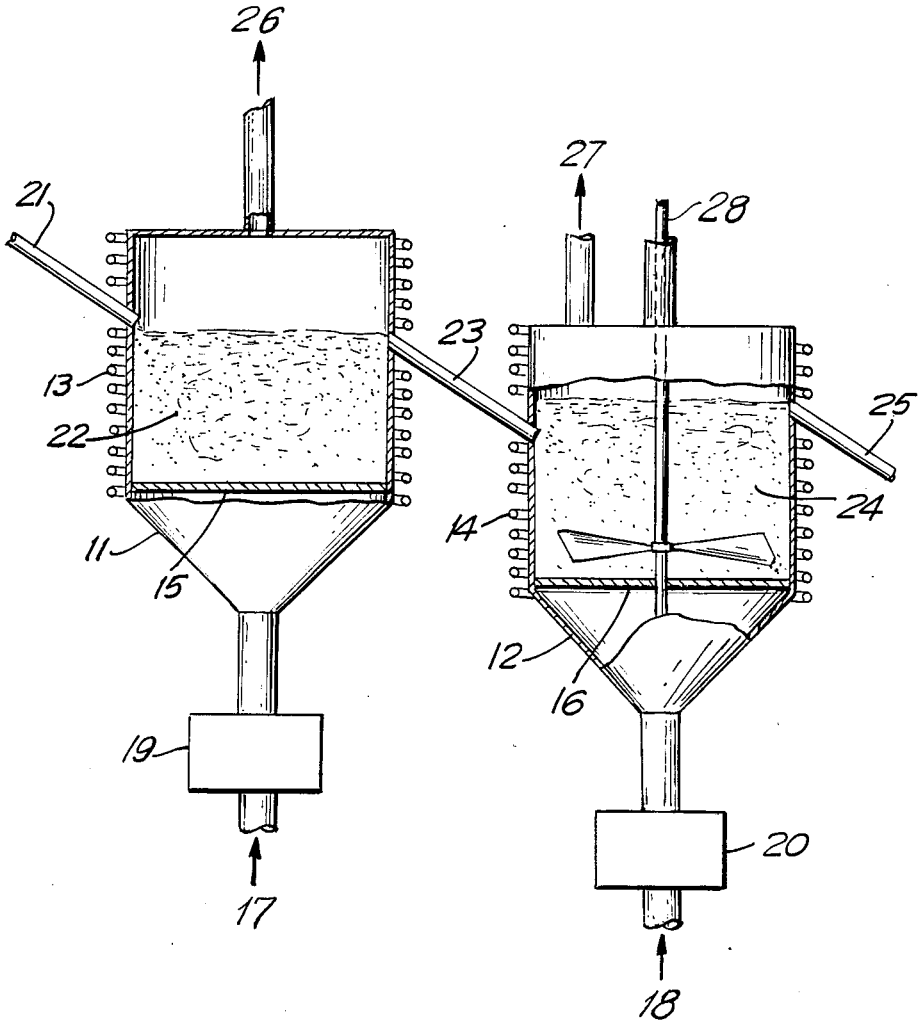
26
21
13
22
11
15
19
17
27
28
23
25
24
14
12
16
20
18

FLUID BED REDUCTION TO PRODUCE MOLYBDENUM METAL

This application is a continuation of application Ser. No. 614,213, filed 5-25-84 abandoned.

The invention is directed to stage-wise reduction of molybdenum trioxide to molybdenum metal in which each reduction stage is conducted in a fluid bed.

BACKGROUND OF THE INVENTION AND THE PRIOR ART

It is known that molybdenum trioxide is considered to be the most important molybdenum compound. In commerce, three common grades of $MoO_3$ are the Technical Grade (approximately 90% or more $MoO_3$), Grade B (approximately 98% $MoO_3$) and Pure Grade (approximately 99.9% $MoO_3$).

The reduction of molybdic oxide (molybdenum trioxide $MoO_3$) to metallic molybdenum has been the subject of considerable investigation. For example, in the November 1964 *Journal of Metals*, A. B. Michael and J. B. Hanway, Jr. pointed out the following:

> "The hydrogen reduction of molybdic oxide has been demonstrated to occur in stages. During the reduction, molybdic oxide successively passes through several lower oxides and eventually metallic molybdenum is produced. The temperatures required for practical degrees of production progressively increase as the lower oxides are formed. For simplicity, however, the reduction may be considered to take place in two stages: (1) molybdic oxide ($MoO_3$) is reduced to molybdenum dioxide ($MoO_2$) at a temperature of approximately 500° C., and (2) molybdenum dioxide ($MoO_2$) is reduced to molybdenum metal at temperatures as low as 750° C.; a more practical temperature for the final state of reduction, however, is about 1000° to 1100° C.

The authors then proceeded to describe their development and testing of a single-stage fluid bed process for converting $MoO_3$ to Mo metal. Their process sought to retain the heat generated in the exothermic first stage of reduction within the reactor so that heat required to preheat the fluidizing hydrogen to accomplish the endothermic second stage of reduction would be kept within practical limits. It was postulated that the $MoO_3$ fed to the reactor would become molten enough to attach itself to the original bed particles before or while being reduced to the dioxide. It was considered this would result in gradual buildup or growth of bed particles so that the final molybdenum product would be granular. Michael et al. found an operating temperature in their single-stage bed approaching 955° C. was preferred. It is known, however, that at temperatures above 650° C., $MoO_3$ will sublime causing the bed to get sticky and eventually defluidize. U.S. Pat. Nos. 2,398,114; 2,987,932; 3,264,098; 3,865,573 and 4,045,216 can also be mentioned. In U.S. Pat. No. 2,398,114, a tube-and-boat furnace was used and batches of water-granulated $MoO_3$ were treated therein stage-wise with the first stage being conducted at a temperature not substantially exceeding 630° C. in an atmosphere of dilute reducing gas which could be hydrogen, carbon monoxide, ammonia or mixtures with sufficient dilution of the reducing gas with dilutents such as steam, nitrogen, or carbon dioxide to control temperature rise in the exothermic first stage. The second stage reduction to molybdenum metal was then conducted in hydrogen at the higher temperature of about 1040° C. U.S. Pat. No. 2,987,392 is directed to the reduction of $MoO_3$ to molybdenum metal in a boat-and-tube furnace using gaseous reductants such as hydrogen, ammonia, carbon monoxide, various hydrocarbons, manufactured atmospheres ("endogas"), metallic vapors and mixtures. It was considered that gaseous reductants were not effective with significant depth in the bed, hence a solid reductant such as hexamine was mixed with the bed material. It was contemplated that the entire reduction to metal could be accomplished using only the solid reductant. U.S. Pat. No. 3,264,098 is directed to reduction of $MoO_3$ to molybdenum metal in a fluid bed which can be either single-stage or multi-stage using hydrogen as the reducing gas. U.S. Pat. No. 4,045,216 is directed to a continuous process for producing a dense pelletized metallic molybdenum product from pelletized molybdenum trioxide feed material in a vertical reactor using hydrogen as the principal reducing agent wherein, in a first stage molybdenum trioxide is reduced to molybdenum dioxide at preferably 600° to 640° C. in hydrogen which is diluted with nitrogen and water vapor and the second stage reduction of molybdenum dioxide to molybdenum is conducted at a temperature exceeding 900° C. using a gas richer in hydrogen than that used in the first stage. U.S. Pat. No. 3,865,573 is directed to the stepwise reduction of molybdenum trioxide to molybdenum dioxide at 500°–600° C. followed by reduction of the dioxide to metal at 800°–900° C. Hydrogen, reformed gas or cracked ammonia are used as the reducing gas. Feed for the process is briquetted with iron or iron oxide powder to provide a metallized ferromolybdenum briquette for addition to molten steel. The patent notes that impurities merely pass through the process. Patent application Ser. No. 603,392, filed Apr. 24, 1984 (AMAX No. 1095) is directed to the reduction of molybdenum trioxide to molybdenum dioxide in a rotary kiln using ammonia as a reductant at a temperature of 400° to 500° C.

The art thus recognizes that the reduction of $MoO_3$ to Mo metal is preferably conducted in stages to yield $MoO_2$ as the intermediate product, with separately controlled atmospheres and temperatures for each stage and using various processing procedures including reactors handling briquetted feed, the rotary kiln and the fluid bed. Both single stage and multi-stage operation are contemplated as well as the use of both static and moving beds of material.

There is no mention in this art of utilizing the reduction process itself to reduce the impurity content of molybdenum. It is known that commercial molybdenum products contain impurities at various levels. These impurities can include iron, aluminum, silicon, lead, tin, copper, zinc and bismuth. Depending upon the desired commercial application for the molybdenum product, such impurities can be more or less harmful. Reductions in the content of at least some of the impurities, including particularly lead, copper, zinc and bismuth would improve the marketability of the molybdenum product having such reduced impurity content.

It is to be recalled in this connection that existing means for removing impurities from molybdenum products are complicated and expensive, since such means involve dissolving the oxide or metal powder, solvent extraction, ion exchange, selective precipitation and the like followed by precipitation of a molybdenum compound such as ammonium molybdate, conversion to oxide and reduction to metal.

It would be of substantial advantage to provide a method for reducing the impurity content of molybdenum during the course of the process of reducing molybdic oxide to metal and it is to such a process that the present invention is directed. Reference is made to the accompanying drawing which depicts too externally heated fluid bed reactors connected in tandem for carrying out the two stage reduction of molybdenum trioxide in the production of molybdenum metal powder.

BRIEF DESCRIPTION OF THE INVENTION

Molybdenum trioxide, such as technical grade oxide (about 90% $MoO_3$) or higher quality grades of molybdenum trioxide containing an impurity from the group consisting of lead, zinc, copper and bismuth is reduced in stages in a fluid bed with first stage reduction to $MoO_2$ being conducted in ammonia as the fluidizing-reducing gas at 400° C. to 650° C., preferably 450° C. and the second stage reduction to Mo metal being conducted in hydrogen as the fluidizing-reducing gas at a temperature between 700° C. and 1400° C., preferably at 1050°-1100° C. Mechanical stirring of the bed is required in the second stage. During reduction removal of impurities from the group consisting of lead, zinc, copper and bismuth occurs. The invention is particularly effective in removing the harmful impurities lead and zinc, the contents of which can be reduced by 90% or more during reduction. Furthermore, the molybdenum powder produced is free flowing.

DETAILED DESCRIPTION OF THE INVENTION

The invention will now be described in conjunction with the drawing in which reference characters 11 and 12 denote fluid bed reactors which may be heated externally as indicated by coils 13 and 14. In each reactor is a distributor plate 15 and 16 which serves to distribute incoming fluidizing-reducing gas 17 and 18. Preheaters 19 and 20 are provided to bring the incoming fluidizing-reducing gas to the required temperature. Molybdenum trioxide to be reduced is fed into reactor 11 at 21. Bed 22 in reactor 21 is almost entirely $MoO_2$. Overflow reduced oxide, $MoO_2$, flows through pipe 23 to serve as feed for reactor 12 in which bed 24 is almost entirely molybdenum powder. Reduced molybdenum powder overflows reactor 12 at 25. Uncracked ammonia is fed at 17 and brought to desired temperature in preheater 19. Heat requirements in reactor 11 are modest since the reduction reactions which convert $MoO_3$ to $MoO_2$ are exothermic. Preferably, the operating temperature within bed 22 is about 450° C., as this operating temperature conserves energy and is remote from a temperature which could bring about defluidization of the bed due to incipient melting and sublimation of $MoO_3$. Ammonia gas flow is sufficient to maintain bed 22 in a state of fluidization but is below the flow rate which would cause loss of bed material through exhaust 26. Exhaust 26 can be provided with precipitators, filters or other devices for recovering fine solids from the exhaust gas and recovery apparatus for the ammonia, if desired. Ammonia is so much cheaper than hydrogen that it may simply be flared, thereby obviating any necessity for gas recycle. Solids residence time in bed 11 can be up to 4 hours. Temperature within bed 22 can be varied between 450° C. and 650° C. Lower temperatures than 450° C. require excessive residence time. It is to be appreciated that, in the fluid bed, dilution and mixing of feed material with bed material (product) occurs with great rapidity. Hence, the likelihood of excessive temperature rise, about which other workers who were using static beds to reduce $MoO_3$ have warned, is remote.

As noted, product $MoO_2$ from reactor 11 overflows bed 22 and is led through pipe 23 to reactor 12 in which the powdered $MoO_2$ is reduced to metal using hydrogen as the fluidizing-reducing gas. Hydrogen is fed at 18 to preheater 20 and is led through distributor plate 16 to fluidized bed 24 which is composed almost entirely of product reduced molybdenum metal. Product metal overflows bed 24 to pipe 25. Conditions in reactor 12 include a temperature in the range of about 700° to 1400° C., preferably 1050°-1100° C. to accomplish substantially complete reduction of $MoO_2$ to metal in 3 to 4 hours residence time. Exhaust 27 can be fitted with filters, precipitators, etc. to remove entrained dust which may be found in the exhaust gas and can be provided with regenerators to dry and recover the effluent hydrogen for return to the process at 18. Hydrogen flow to reactor 12 is sufficient to fluidize the bed but well below the feed rate which would blow bed material out of the exhaust. It can be considered that each individual particle in the beds of reactors 11 and 12 is surrounded by fluidizing gas. Gas-solid contact hence is at the maximum. Impurity atoms contained within the individual bed particles are given time to diffuse to the particle surface from which they may be volatilized into the surrounding gas stream. A mechanical stirrer, indicated at 28 is needed in reactor 12. A similar stirrer is needed in reactor 11 only if pure oxide feed is employed.

The particle size of the oxide feed material will usually be substantially uniform and will reside in the particle size suitable for treatment in the fluid bed as known to those skilled in the art.

As an illustration of the problem which the invention seeks to solve, the analyses of various grades of molybdenum trioxide are given illustratively as follows:

| | Technical Grade | Grade B | Pure Oxide |
|---|---|---|---|
| % Fe | 1.0 | 0.84 | 0.001 |
| % Al | 0.3 | 0.11 | 0.0008 |
| % Pb | 0.03 | 0.036 | 0.0002 |
| % Si | 3.0 | 0.53 | 0.001 |
| % Sn | 0.003 | <0.004 | 0.001 |
| % Cu | 0.1 | 0.035 | 0.001 |
| % Zn | 0.05 | 0.043 | 0.001 |
| % Bi | 0.004 | 0.0025 | 0.001 |
| % $MoO_3$ | 90 | 98 | 99.9 |

It is, of course, desired to provide a metal product as devoid of impurity metals as is possible. In addition, the metal product should contain no more than 2.5% oxygen, 0.015% nitrogen, 0.10% carbon, 0.15% sulfur, 0.05% phosphorus.

In one run using apparatus as illustrated, with ammonia in the first stage reactor at a temperature of 450° C. and hydrogen in the second stage reactor at 1050° C., 27 pounds per hour of Grade B oxide having the analysis given in the Table was processed using 2 standard cubic feet per minute of ammonia in the first stage and 8 pounds per hour $MoO_2$ feed rate to the second stage using 3 standard cubic feet per minute of hydrogen with average residence time of 2 hours in the first stage and 6 hours in the second stage. The product molybdenum powder contained 1.03% Fe, 0.15% Al, 0.0012% Pb, 0.67% Si, <0.004% Sn, 0.044% Cu, 0.0010% Zn, <0.004% Bi, 2% $O_2$, 0.006% C, <0.015% $N_2$, 0.0025% S, 0.0013% P, by weight. This represented, for example, removal of 97% of the lead contained in the original $MoO_3$.

Calculated on the basis of molybdenum content of the materials involved (a basis which is more illustrative since weight is lost due to oxygen removal during reduction) the following assays were obtained for the starting Grade B oxide, the $MoO_2$ material after first stage reduction and the Mo material resulting from second stage reduction.

| Mo Basis | Grade B Oxide | First Stage Reduction | Second Stage Reduction |
|---|---|---|---|
| Mo | 64.8 | 70.8 | 95.5 |
| Fe | 1.30 | 1.38 | 1.08 |
| Si | 0.82 | 0.70 | 0.70 |
| Al | 0.17 | 0.14 | 0.16 |
| Pb | 0.056 | 0.062 | 0.0013 |
| Zn | 0.066 | 0.061 | 0.0011 |
| Cu | 0.054 | 0.049 | 0.046 |
| Bi | 0.0039 | 0.0032 | <0.004 |
| Sn | <0.0062 | <0.0056 | <0.004 |

The results show almost quantitative removal of lead and zinc, significant reduction in copper and positive reduction in bismuth although the bismuth level in this sample was so low as to give difficulties in analysis.

The data demonstrate that starting molybdenum trioxide contaminated with 0.02% or 0.04% or 0.05% or more of the impurities lead and zinc can be treated to provide removal of 90% or 97% or more of the impurities during fluid bed reduction according to the invention.

It is to be appreciated that ammonia can be used as atmosphere in the second stage reduction, but could result in a nitrogen content of 0.2% by weight which could be considered undesirable in some applications. It is also to be appreciated that the product highly metallized molybdenum powder can be consolidated as by briquetting to provide dense, metallic bodies useful as addition agents, if this is considered desirable in some situations.

Fluid bed reduction in accordance with the invention can be conducted batch-wise without practical difficulties.

It will be appreciated that the coils 13 and 14 shown in the drawing are merely symbolic of heating means and that heat may be provided by electrical resistance, by induction (at least for reactor 12), by fuel firing, etc.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. In the process for the stage-wise reduction of molybdenum trioxide to molybdenum metal wherein said molybdenum trioxide contains an impurity amount of at least one impurity from the group consisting of lead, zinc, bismuth and copper and wherein, in the first stage, molybdenum trioxide is reduced to molybdenum dioxide at a temperature not exceeding 650° C. and in the second stage molybdenum dioxide is reduced to molybdenum metal at a temperature of at least about 700° C., the improvements comprising accomplishing each of said stages in a fluid bed employing a fluidizing-reducing gaseous atmosphere introduced as uncracked ammonia in said first stage and said second stage is conducted using a fluidizing-reducing atmosphere introduced as a gas selected from the group consisting of uncracked ammonia and hydrogen with mechanical stirring of the bed, to accomplish substantial removal of said impurity from material being treated and production of excessive fines in the molybdenum product is avoided.

2. The process in accordance with claim 1 wherein said first stage is conducted at about 450° C. and said second stage is conducted in hydrogen at about 1050°–1100° C.

3. The process in accordance with claim 1 wherein said impurity is lead and lead removal is accomplished to the extent of at least about 90%.

4. The process in accordance with claim 1 wherein said impurity is zinc and zinc removal is accomplished to the extent of at least about 90%.

* * * * *